United States Patent [19]

Dowdy

[11] 4,083,597

[45] Apr. 11, 1978

[54] FOLDING ARTICLE OF FURNITURE

[76] Inventor: Ernest Nathan Dowdy, P.O. Box 224, Hiawassee, Ga. 30546

[21] Appl. No.: 741,546

[22] Filed: Nov. 15, 1976

[51] Int. Cl.[2] ..... A47B 39/00

[52] U.S. Cl. ..... 297/21; 297/191; 108/113

[58] Field of Search ..... 297/21, 25, 26, 42, 297/44, 48, 159, 191; 108/113, 118, 119, 120

[56] References Cited

U.S. PATENT DOCUMENTS

| | | | |
|---|---|---|---|
| 287,739 | 10/1883 | Tull | 108/113 |
| 685,017 | 10/1901 | Umstead et al. | 297/191 |
| 2,493,084 | 1/1950 | Pharo | 297/48 |
| 2,587,010 | 2/1952 | Thompson | 108/113 |
| 3,692,358 | 9/1972 | Sung | 297/159 |

FOREIGN PATENT DOCUMENTS

| | | | |
|---|---|---|---|
| 403,678 | 12/1933 | United Kingdom | 297/21 |

*Primary Examiner*—Roy D. Frazier
*Assistant Examiner*—Peter A. Aschenbrenner

[57] ABSTRACT

A folding article of furniture including parallel pairs of crossed first legs and second legs pivotably joined to each other, first and second arms pivotably joined, respectively, to the top ends of the first and second legs, a first top piece overlaying and joined to the distal portion of the first arms, a second top piece overlaying and joined to the distal portions of the second arms and a brace transversely joining the lower portion of the first legs. A back assembly, which converts the article to a chair, is pivotably joined to the distal ends of the first arms and includes a lower end portion which engages the brace and the first legs to limit pivoting of the back assembly. In some forms, a handle joins the proximal ends of corresponding arms.

7 Claims, 13 Drawing Figures

FOLDING ARTICLE OF FURNITURE

BACKGROUND OF THE INVENTION

1. Field of the Invention

This invention relates to a foldable article of furniture.

2. Description of the Prior Art

Folding tables, folding chairs and other folding articles of furniture are well known. Frequently, such articles are unduly complex or unstable, being difficult to set up for use and difficult to knock down for storage. Such articles are usually useful only for a limited purpose and cannot be converted, for example, from a table to chair.

A typical folding table having abutting top pieces is disclosed in U.S. Pat. No. 2,587,010 issued Feb. 26, 1952. This prior art is not convertible to a chair and also depends for stability only upon a single axle passing through the intersection of the crossed legs and upon top pieces. In its storage configuration, the handle of the prior art table is positioned at about the same height as the center of gravity, causing possible inconvenience and instability when being transported. Other articles of folding furniture are disclosed in U.S. Pat. Nos. 1,890,710; 3,074,734; 3,080,202; 3,099,356; 3,215,096; and 3,602,160.

SUMMARY OF THE INVENTION

Briefly disented, the present invention includes an article of furniture in which the leg support assembly includes a plurality of spaced pairs of criss-crossed legs pivoted by their central portions to provide a plurality of spaced parallel upwardly and forwardly extending first legs and a corresponding number of spaced upwardly and rearwardly extending second legs, respectively disposed adjacent to the first legs with transversely aligned pivot pins joining the intersecting central portion of each pair of legs.

At the upper or distal end portions of the first legs, pivot pins respectively carry a corresponding number of rearwardly extending first arms while, at the upper end portions of the second legs, pivot pins respectively carry a like number of rearwardly extending second arms which are respectively adjacent and parallel to the forwardly extending arms.

The outer end portions of the first arms carry a flat first panel and the outer end portions of the second arms carry a second flat panel, the inner edge of which abuts the inner edge of the first panel. Thus, the panels are coplanar, being disposed by their supporting legs in a horizontal plan in which the first panel overlie the rear portions of all arms and the second panel overlie the forward portions of all arms.

At a position spaced from the central pivot pins, the legs, are provided which transversely extends braces, preferably at their proximal end portions, one brace joining the proximal ends of all first legs and the other brace joining the proximal ends of all second braces.

In those embodiments having only two pairs of legs, the forwardly extending first legs are preferrably outwardly of the rearwardly extending second legs and the first arms, carried by first legs, are outwardly adjacent thereto. Also, the second arms are inwardly adjacent the second legs and the pivot pins joining these second legs and arms protrude from the ends of a transversly extending rod which forms a tranportation handle when the article is folded to its storage condition.

One form of the invention is convertible between a table or stool and a chair by adding to the table or stool, a rectangular back frame including opposed parallel side struts and, a back support extending between the side struts, adjacent their outer ends. The back frame also includes a bottom strut extending between the inner ends of the side struts. Each side strut has a intermediate portion pivotably joined to distal ends of the first arms, each side strut being of sufficient length to engage the first legs and their associated brace to limit rotation of the back when the article of furniture is in use.

In some forms of the invention one or more spaces, panels or leaves are provided so as to be removeably inserted between the first and second top panels to form a second use configuration in which a top surface is formed higher and wider than that formed by the first and second top panels alone.

DESCRIPTION OF THE PREFERRED EMBODIMENTS

Figure 1:
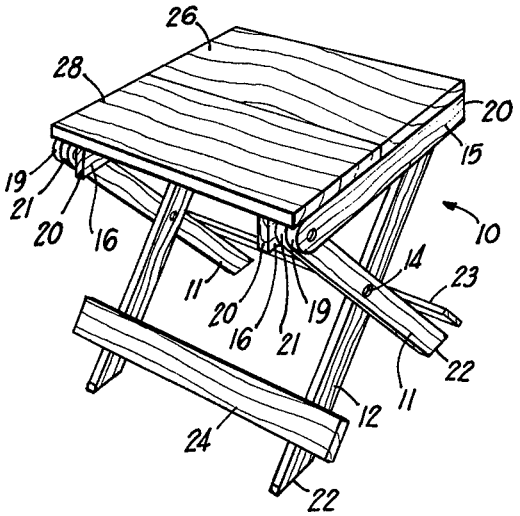
FIG. 1 is a perspective view of a stool according to a first embodiment of the invention, the structure being disposed in its basic use configuration.

With reference to FIGS. 1–6, the present invention is illustrated by a stool or table 10. In its use configuration shown in FIGS. 1–3, the stool 10 has two spaced parallel upwardly and forwardly extending first legs 11 and two spaced parallel upwardly and rearwardly extending second legs 12, each first leg 11 being sidewide adjacent to a second leg 12. Adjacent pairs of first and second legs are criss-crossed being joined near their mid points by a central pivot pin or bolt 13 passing through an aperture 14 in each leg. The two crossed pairs of legs 11 and 12 are spaced from each other, with the bolts 13 being transversely aligned to define a transverse central axis.

Figure 2:
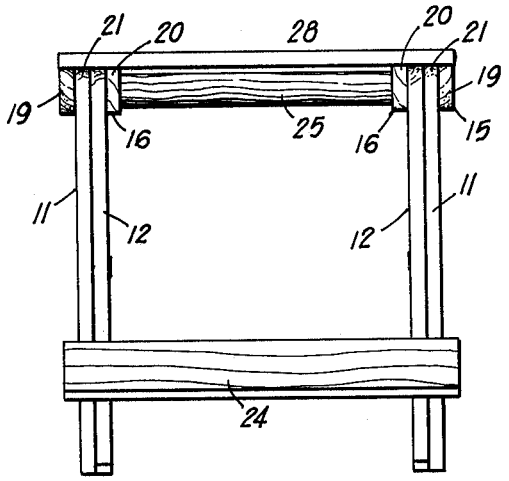
FIG. 2 is a front elevational view of the stool shown in FIG. 1.

Adjacent each first leg 11, near its upper or distal end, is pivotally mounted a rearwardly extending first arm 15. Beside each second leg 12 near its upper or distal end is a forwardly extending second arm 16. As shown in FIG. 2, the arms and legs are juxtaposed, a first arm 15 on the outside, then a first leg 11, then a second leg 12, and finally a second arm 16 on the inside. The other set of arms and legs are complimentary thereto so that the stool 10 symmetrical. Each arm is joined to the adjacent leg by a pivot pin or bolt 17 passing through apertures 18 near the adjacent ends of each arm and leg.

Figure 3:
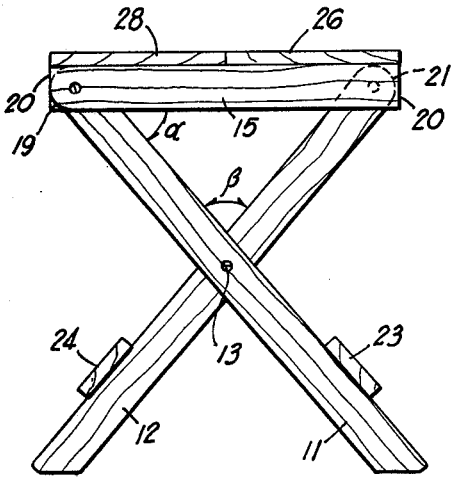
FIG. 3 is a side elevational view of the stool shown in FIG. 1.

As can be seen in FIGS. 1 and 3, the arms 15 and 16 are parallel and extend from rounded ends 19 near the apertures 18 to the flat ends 20 away from the apertures 18. The rounded end 19 of each first arm 15 is aligned with the flat end 20 of each second arm 16 and the rounded top end 21 of each first leg 11. The rounded end 19 of each second arm 16 is aligned with the flat end 20 of each first arm 15 and the rounded top end 21 of each second leg 12. Thus, each end of an arm or leg having an aperture and a bolt therethrough is rounded concentrically. The legs 11 and 12 extend downwardly from the bolts 17 inwardly at an angle A, shown best in FIG. 3. The legs 11 and 12 cross at bolt 13 to form a second or interior angle B, therebetween.

Joining the front surfaces first legs 11 below their apertures 14 and near their flat bottom ends 22 is a flat rigid first brace 23, which holds them in a parallel relation. In like fashion both second legs 12, below their apertures 14 near their flat bottom ends 22, are joined by a second brace 24 which holds them in a parallel relation.

As shown in FIG. 2, a handle or cylindrical rod 25 extends between the rounded ends 19 of the second arms 16. The handle is fastened to these ends 19 or, conveniently, the pivot pins or bolts 17, joining the second arms 16 to the second legs 12, are longer than the thickness of the legs and arms so as to extend inwardly and be received in boxes in the ends of the handle 25.

Joining the outer portions of first arms 15 is a flat slab or board or joined group of boards referred to herein as the first top piece or first top panel 26. As shown in FIGS. 1, and 3, the first top panel 26 extends sidewise to align with the outside of each first arm 15 and, as seen best in FIG. 4, endwise, to align with the flat ends 20 of the first arms 15. First top panel 26 extends endwise from the flat ends 20 of the first arms 15 about halfway toward the rounded ends 19 of the first arms 15, terminating in a first flat inner end surface 27 best seen in FIGS. 4 and 5.

Figure 4:
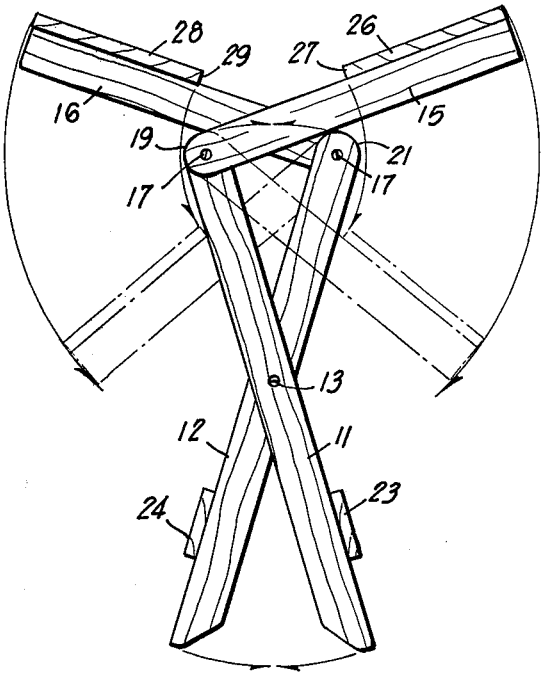
FIG. 4 is a side elevational view of the stool shown in FIG. 1, in an intermediate position between its use configuration and a folded configuration, a position further toward the folded position of the stool being shown in broken lines.

Overlaying and joined to both second arms 16 is a flat slab or board or group of boards referred to herein as second top piece or top panel 28. Second top panel 28 extends sidewise beyond the second outside of second arms 16 to align with the outside of the first arms 15, and extends endwise from the flat ends 20 of the second arms 16 about half way toward the rounded ends 19 of the second arms 16 terminating in a second flat inner end surface 29 as shown in FIG. 4.

Each of the bolts 13 provides a pivotable connection between the middle of the middle or central portion of a first leg 11 and the middle or central portion of a second leg 12, each having thereby a central or second pivot point at bolt 13. Each of the bolts 17 provides a pivotable connection between the rounded end 21 of a leg 11 or 12, forming thereby its first or end pivot point, and the rounded end 19 of an arm 15 or 16, forming thereby its third pivot point.

Thus, in its use configuration, the abutting of inner end surfacs 27 and 29 adds stability to the stool 10. Downward pressure on the arms 15 and 16 by way of the top halves, pieces or panels 26 and 28 urges the portions about the bolts 17 downward so as to increase the angle between the legs 11 and 12 to an amount greater than angle B. This force urges the top panels 26 and 28 together, and their mutual resistance at abutting surfaces 27 and 29 prevents any such movement, and thus prevents any rotation about the bolt 13. The overlaying relationship between first top panel 26 and second arm 16, and between second top half 28 and first arm 15, prevents any pivoting about the bolts 17 as the top pieces are urged downward. Thus the stool 10 is even more stable when an object or person overlays the top panels 26 and 28. Furthermore, the top panels 26 and 28, the braces 23 and 24, and the handle 26 all maintain the arms and legs in parallel relationship, preventing twisting of the stool.

The stool 10 may be pivoted out of its use configuration by pulling the first top panel 26 away from the second top panel 28 while pivoting both top panels and their joined arms upwardly about the bolts 17. As this happens, adjacent legs 11 and 12 will begin pivoting about the adjacent bolt 13 so as to reduce the angle therebetween from angle B. This lifting motion is to be continuous until the stool 10 is in the configuration shown in solid lines in FIG. 4.

Next, the arms 15 and 16 and the associated top panels 26 and 28, respectively, may be pivoted downwardly. The inner end faces 27 and 29 will clear the top end 21 of the second leg 12, and the top end 21 of the first leg 11, respectively, as this downward continues through the position shown in broken lines in FIG. 4. At about the time the arms 15 and 16 reach this broken line position, the pivoting of the legs 11 and 12 about the bolts 13 may resume.

Figure 5:
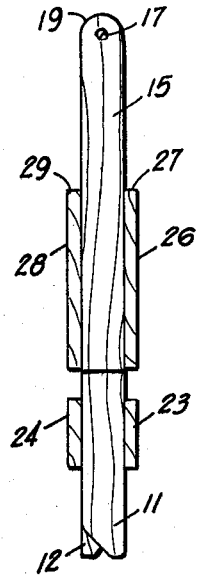
FIG. 5 is a side elevational view of the stool shown in FIG. 1 the stool being in is folded or storage configuration.
Figure 6:
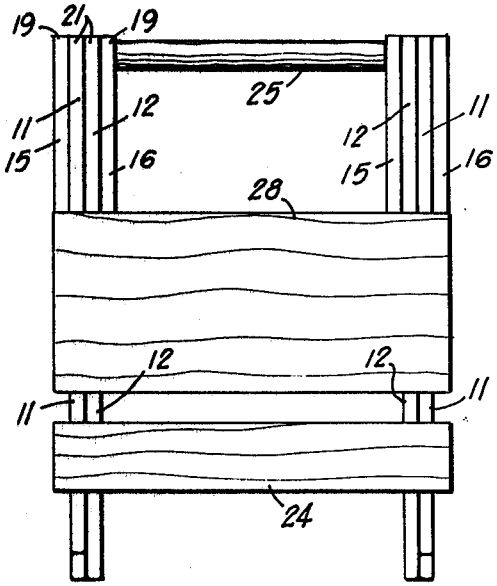
FIG. 6 is front elevational view of the stool shown in FIG. 5.

Both pivoting motions then continue until all of the arms 15 and 16 and legs 11 and 12 are parallel, as shown in FIGS. 5 and 6. Thus, the second brace 24 will overly what was previously the bottom side of the first legs 11, the first brace 23 will overly what was previously the bottom side of the second legs 12 and the second brace 24 is on the opposite side of each leg compared to the first brace 23. It will also be undeplored that the first top panel 26 overlyes all four legs 11 and 12 on the same side as the second brace 23, and the second top panel 28 overlyes all four legs 11 and 12 on the same side as the first brace 23, as best seen in FIG. 5. These overlying top pieces and braces terminate pivotal motion at the storage configuration, with all arms and legs being parallel. It will be appreciated that braces 23 and 24 are joined and positioned downwardly on the corresponding legs 11 and 12 by a sufficient distance so as to not overlap with the top panels 26 and 28, respectively, in this storage configuration.

The stool 10 can thus be carried by the handle 25, which extends transversely across the top of the stool 10, without any danger of the arms and legs pivoting out of this storage configuration. About the pivot point formed by the bolt 13, the only symmetrical weights on the legs 11 and 12 are the weights of the braces 23 and 24, respectively, which would tend to resist pivoting out of this storage configuration. Similarly, about the bolts 17, the only asymmetrical weights are the weights of the top panels 26 and 28 which would tend to resist pivoting out of this storage configuration.

Thus, the folding stool 10 provides maximum stability in both its use and storage configurations, with a minimum of complicating structure and a high degree of compactness in the storage configuration.

Figure 7:
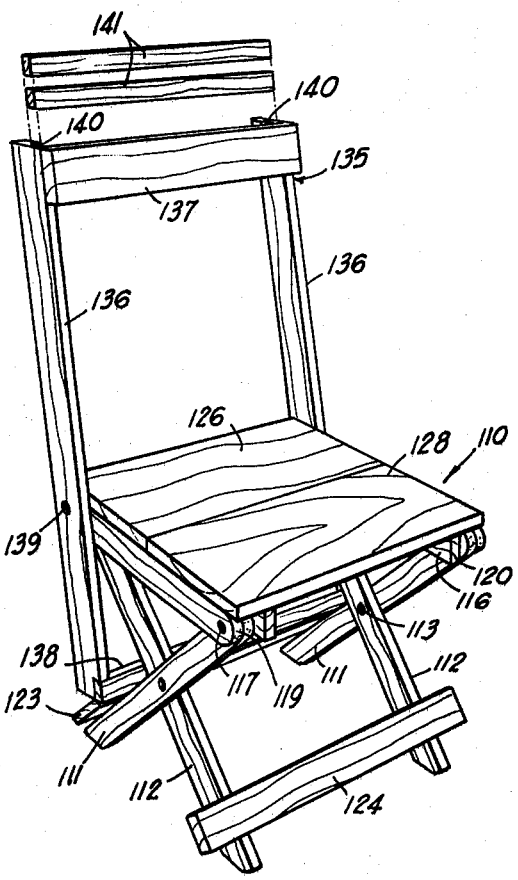
FIG. 7 is an exploded perspective view of a chair according to a second embodiment of the invention, the chair being in its basic use configuration.
Figure 8:
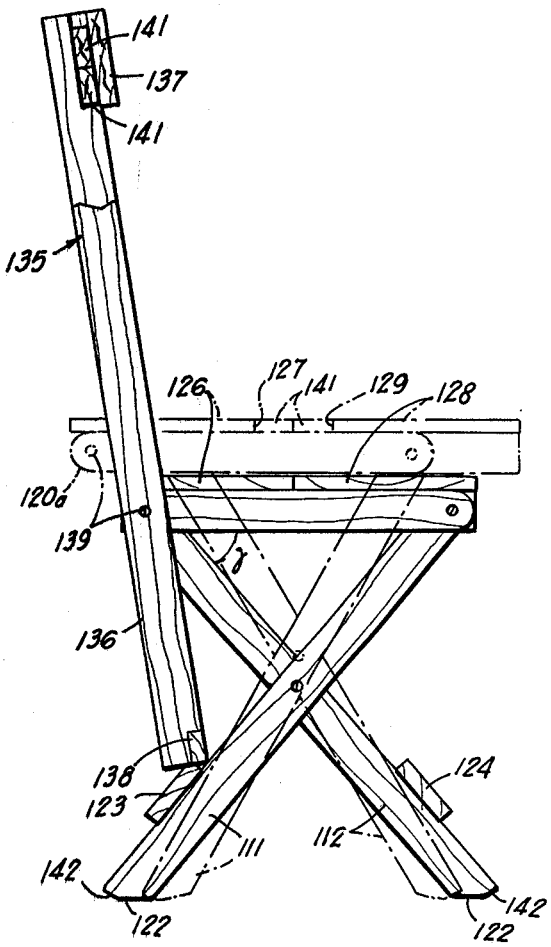
FIG. 8 is a side elevational view of the chair depicted in FIG. 7, the broken lines showing the position of the elements of the chair when the spaces, panels or leaves are being used.
Figure 9:
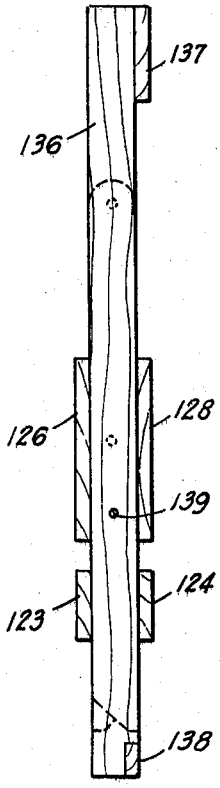
FIG. 9 is a side elevational view of the chair of FIG. 7 in its folded or storage configuration.

In FIGS. 7–9 a second embodiment is depicted showing a chair 110. The basic structure of the chair 110 is similar to the stool 10 of the first embodiment, with spaced pairs of crossed parallel first legs 111 and second legs 112 pivotably joined by their central portions at bolts 113. The first legs 111 are maintained in parallel alignment by a first transverse brace 123, extend between the two, and the second legs 112 are held in parallel relation by a second brace 124 extending between the two. Each pair of braces, normally extends outwardly of their legs.

The first arms 115 extend from a rounded end 119, where they are pivotably attached to corresponding first legs 111 by bolts 117, to rounded ends 120*a*. Similarly, second arms 116 are pivotably joined to second legs 112 and extend from a rounded end (not shown) to a flat end 120. As discussed below, the end of the first arms 115, distal the bolts 117, are rounded rather than being flat as the back element is attached nearby.

Overlaying the first arms 115 at a portion distal to their bolts 117, is a first top piece or panel 126. Overlying and attached to the second legs 116 adjacent their flat ends 120 is a second top piece or panel 128. In the use configuration shown in FIG. 7, the first top panel 126 overlies the second arms 116 and the second top panel 128 overlies the first arms 115. Inner end surfaces of the top panels 126 and 128 abut against each other to add stability to the chair 110, when an object seated thereon urges the top panels downward.

It will be appreciated that thus far, the chair 110 is identical to the stool 10, described above, except that no handle equivalent to handle 25 has been provided and both ends of the first arms 115 are rounded.

A generally rectangular back frame 135 is provided including two parallel side struts 136, the outer ends of which are joined by a transverse back support 137 and a bottom bar 138. The side struts 136 are each apertured below their midpoints and receive bolts 139 which pivotably connect the side struts 136 with the ends of the first arms 115, opposite their bolts 117.

In the use configuration shown, the back frame 135 is upright, being inclined rearwardly so that the bottom bar 138 engage both the first brace 123 and the first legs 111. This engagement supports the back frame 135 and, in particular, prevents rotation of the back frame 135 from pivoting rearwardly.

Pivotable motion forwardly of the back frame 135 about the bolts 139 is permissable once the legs 111 and 112 have been pivoted to begin the folding process. It will be appreciated that the bottom bar 138 will either ride up the leg 111 or position itself free of the leg 111 and the first brace 123, after which the back frame 135 swings freely about the bolt 139. By pivoting forwardly, slightly, in the direction shown in the arrows, the back frame 135 is freed of the other structure, such that the legs and, thus, the top panels 126–128, may all be folded together, as described above in connection with the stool 10. The back frame 135 may then be pivoted downwardly about the bolt 139 until the side struts 136 are parallel to all of the arms and legs and extends upwardly beyond the curved portions 19 and downwardly beyond the bottom ends 122 of the legs. As a result, the legs are aligned in a common plane and the back support 137 now extends parallel to the first top panel 126 and the first brace 123, while the bottom bar 136 extends sidewise within the plane of the arms and legs, below all of them. The spacer boards 141 also extend sidewise in the plane of and above the arms and legs. This storage configuration is shown in FIG. 9.

The chair 110 is convertible into a stool or table by removing the bolts 139 and the back frame 135. If a larger table is desired, the arms and legs may be lifted, as by the first and second top panels 126 and 128 from the position shown in solid lines in FIG. 8 to or beyond the configuration shown in broken lines in FIG. 8. The spacer boards or inserts 141 may then be removed from the slots 140 and inserted between the inner and surfaces 127 and 129 so as to increase the length of the table top formed by the top panels 126 and 128 as shown in broken lines in FIG. 8. This will increase the angle between leg 111 or 112 and its corresponding arm 115 or 116 from J to S. The angle between each first leg 111 and the adjoining second leg 112 will be reduced from angle to angle thereby.

Since the legs 111 and 112 are thus sloped more steeply, the table top formed by panels 126, 128 and spaces insert 141 in the configuration shown in broken lines in FIGS. 8 will be higher than the table panels 126 and 128 in the configuration shown in solid lines in FIGS. 7 and 8. It should be appreciated that a higher and longer table may be formed by inserting wider spacer boards or inserts 141, but that, eventually, this sharp upward slope of legs 111 and 112 will cause instability because of the narrow distance between their bottom ends 122 are beveled at 142 so as to indicate the maximum desirable displacement by addition of spacer boards 141 or other similar spacer boards.

It should be appreciated that the chair 110 offers a great deal of flexibility, being convertible between a chair and a stool or table. Furthermore, by the use of spacer boards 141, the stool may be enlarged, as desired. While the chair 110, including the back frame 135, may also be raised and extended, it should be appreciated that, in this configuration, the bottom 138 will engage the first leg 111 at a point higher than the first brace 123, and thus be somewhat less stable. It should also be appreciated that the side pieces 136 would extend at a greater angle from the vertical, thus making the chair 110 more of a recliner.

The spacer boards 141, or similar spacer boards, may be used to extend the stool 10, in the first embodiment or the bench 220, described below as a third embodiment.

Figure 10:
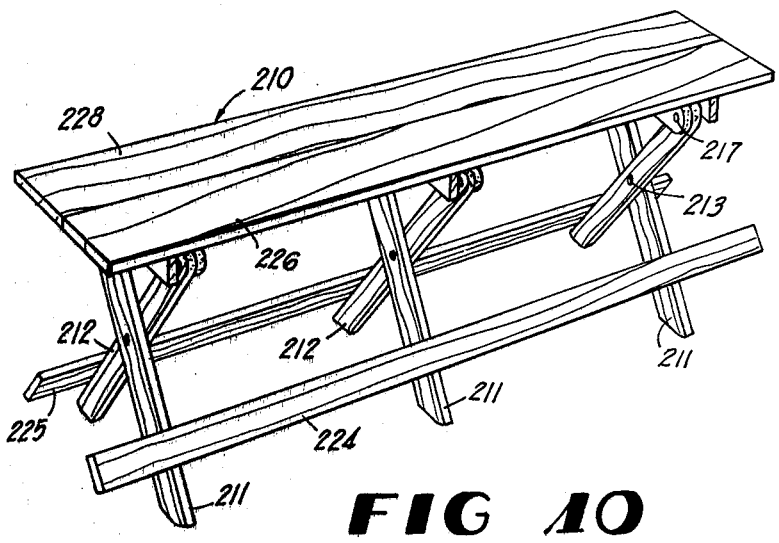
FIG. 10 is a perspective view of a bench according to a third embodiment of the present invention.
Figure 11:
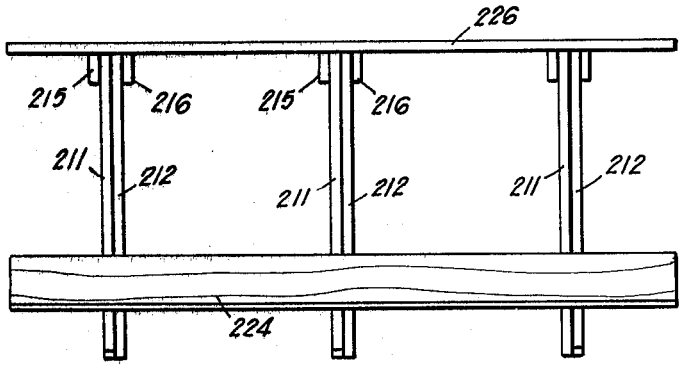
FIG. 11 is front elevational view of the bench of FIG. 10.
Figure 12:
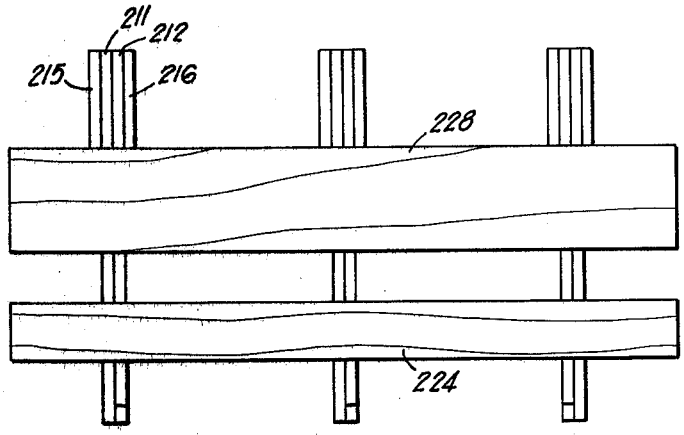
FIG. 12 is a view similar to FIG. 11 with the bench in its folded or storage configuration.

The third embodiment of the invention is illustrated as a bench 210 as shown in FIGS. 10–12. The bench 210 includes three pairs of crossed first legs 211 and second legs 212, similar in all respects to the first legs 11 and second legs 12 of the stool 10. As shown in FIGS. 10 and 11 the endwise arrangement includes first a first leg 211, then a second leg 212, then a first leg 211, then a second leg 212, then a first leg 211, and finally a second leg 212. This asymmetrical arrangement differs somewhat from the symmetrical arrangement of the stool 10, with each being used in different modifications. It will be understood, however, that if a back member, such as brace 135, of the second embodiment, is to be added, then one end set of a first leg 211 and a second leg 212 must be reversed so that parallel legs will be on the outside for attachment of the back frame.

A first arm 215 is pivotably attached to each first leg 211 and a second arm 216 is attached to each second leg 212 in the same manner as arms 15 and 16 of the stool 10. Overlaying and holding in parallel relation the first legs 211 is a first brace 224 similar to first brace 24 of the stool 10. Overlaying and holding in parallel relation the second legs 212 is a second brace 225 similar to second brace 23 of the stool 10. Overlying and joining the distal portions of each first arm 215 is a first top panel 226 similar to top panel 26 of the stool 10. Overlaying and attached the distal portion of each second arm 216 is a second top panel 228.

The bench 210 will fold into the storage configuration shown in FIG. 12 by the same mechanical operations used for the stool 10 as best shown in FIG. 4. The bench 210 is thus quite stable and folds into a compact storage configuration.

It is apparent that the bench 210 may be a convertible structure, similar to the chair 110, by providing a back frame similar to frame 135 of the second embodiment. This back frame could be pivotably attached to the first top panel. Alternatively, one end set of arms and legs 211, 212, 215 and 216 could be reversed so as to present similar arms 215 on the outside. Conveniently, the top panels 226 and 228 and the braces 224 and 225 would then be shortened to align with these outside arms 215 and the back frame could pivot thereabout without engaging any other structure. From the side, the bench with a back would look identica; to the chair shown in solid lines in FIG. 8.

Also, spacer boards or inserts of the proper length, otherwise similar to inserts 141 in the second embodiment, can be inserted between the top panels 226 and 228 so as to make the bench higher and wider. This higher and wider bench is identical to the higher and wider configuration shown in broken lines in FIG. 8.

Figure 13:
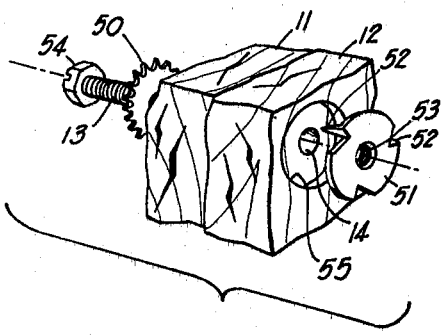
FIG. 13 is an enlarged exploded perspective view of a portion of the chair of FIG. 1.

Although any pivotable connection is contemplated by the present invention in place of bolts 13, 17, 113, 117, 139, 213 and 217, an exemplary form is shown in FIG. 13. By way of example, the connection between a first leg 11 and a second leg 12 of the stool 10 of the first embodiment is shown, but it should be understood that the same connection is contemplated at every other pivot point. The bolt 13 passes through a washer 50, through the aperture 14 in first leg 11, through the aperture 14 the second leg 12 and, finally, through a threaded element 51. A series of tines 52 projecting inwardly from the threaded element 51 penetrates into the second leg 12 to prevent relative rotation therebetween, and the bolt 13 is threadably received by internal threads 53 of the threaded element 51. Thus, no relative rotation should occur between the bolt 13 and the second leg 12. Preferably, the head 54 of the bolt 13 and the washer 50 are each received within a countersunk recess around the aperture 14 of the first leg 111 so as to prevent them from protruding beyond the first leg 11. A similar countersunk recess 55 about the aperture 14 of the second leg 12 receives the threaded element 51. It should be appreciated that this countersinking assists in maintaining the compactness of the stool 10, the convertible chair 110 and the bench 210.

It should be understood that the just described embodiments merely illustrate principles of the invention in preferred forms. Many modifications may, of course, be made to these embodiments without departure from the spirit and scope of the invention as set forth in the following claims.

I claim:

1. A foldable article of furniture comprising in combination:

(a) a plurality of crossed pairs of legs, each pair including a first leg and a second leg, each leg having a first pivot point adjacent the top end of each leg and a second pivot point intermediate its ends, each first leg being pivotably joined to a corresponding second leg at their respective second pivot points;

(b) a plurality of first and second arms each having a third pivot point adjacent an end, each of said first arms being pivotably joined to a first leg between the third pivot point and the first pivot point, each of said second arms being pivotably joined to a second leg between the third pivot point and the first pivot point;

(c) a first top panel extending normally and overlying and joined to each of said first arms distal to the third pivot points thereof and including an inner face at the end proximal the third pivot points of said first arms;

(d) a second top panel overlying and joined to each of said second arms distal to the third pivot points thereof and including an inner face at the end proximal the third pivot points of said second arms;

(e) a brace overlying and joined to said first legs extending normally to and adjacent to the bottom ends thereof distal said first pivot points;

(f) said first arms being held in parallel relation by said first top panel, said second arms being held in parallel relation by said second panel and said first legs being held in parallel relation by said brace; and (g) a removable spacing insert removably received over the intermediate portions of said arms and clamped by and between the inner faces of said first panel and said second panel.

2. A foldable article of furniture as claimed in claim 1 wherein each first leg is sidewise adjacent to a second leg, each first arm is sidewise adjacent a first leg on the side opposite the adjacent said second leg, and each second arm is adjacent a second leg on the side opposite the adjacent first leg;

said arms, legs and top panels being dimensioned to permit a first configuration with said first top panel overlying the portion of said second arms proximal to the third pivot points thereof, said second top panel overlying the portion of said first arms proximal to the third pivot points thereof and the inner face of said first top piece abutting against the inner face of said second top piece.

3. A foldable article of furniture as claimed in claim 2 further comprising a back frame including two side members, a back support extending between said side members adjacent their top ends and a bottom bar extending between said side members adjacent their bottom ends, each side member having a fourth pivot point intermediate its ends;

two of said first arms each having a fifth pivot point adjacent the end distal to said third pivot points, each of said fourth pivot points being pivotably joined to one of said fifth pivot points;

said side members having sufficient length between said fifth pivot points and said bottom bar for said bottom bar to engage said first legs and said brace to limit rotation about said fourth pivot points when said article of furniture is in said first configuration.

4. A foldable article of furniture as claimed in claim 3 wherein said back frame further including means adjacent said back support for removably receiving and holding said removable spacing insert.

5. A foldable article of furniture as claimed in claim 2 further comprising a removable spacing insert fitted over the intermediate portions of said arms and having one side abutting the inner face of said first top panel and the opposite side abutting the inner face of said second top panel for forming a second configuration with a top surface higher and wider than that formed by said first and second top panels in said first configuration.

6. A foldable article of furniture as claimed in claim 2 further comprising a second brace overlying and attached to said second legs and holding said second legs in parallel relationship.

7. A foldable piece of furniture as claimed in claim 2 including two of said first legs, two of said second legs, two of said first arms, two of said second arms; and said arms, legs and first and second top pieces are dimensioned such that, in said first configuration, said top ends of said first legs, said proximal ends of said first arms, said distal ends of said second arms and the face of said first top piece opposite the inner face thereof are all in substantial alignment and, in said first configuration, the top ends of said second legs, the proximal ends of said second arms, the distal ends of said first arms and the face of said second top piece opposite the inner face thereof are all in substantial alignment.

* * * * *